US007506388B1

(12) United States Patent
Brown

(10) Patent No.: US 7,506,388 B1
(45) Date of Patent: Mar. 24, 2009

(54) INVALID LIFT APPARATUS

(76) Inventor: Worth A. Brown, 713 Clover Ave., Essex, MD (US) 21221

( * ) Notice: Subject to any disclaimer, the term of this patent is extended or adjusted under 35 U.S.C. 154(b) by 0 days.

(21) Appl. No.: 12/181,690

(22) Filed: Jul. 29, 2008

(51) Int. Cl.
*A61G 7/12* (2006.01)
*A61G 7/14* (2006.01)

(52) U.S. Cl. ..... 5/86.1

(58) Field of Classification Search ..... 5/81.1 R–89.1
See application file for complete search history.

(56) References Cited

U.S. PATENT DOCUMENTS

| | | | | |
|---|---|---|---|---|
| 5,117,516 | A * | 6/1992 | Penner | 5/86.1 |
| D327,762 | S | 7/1992 | Silversky et al. | |
| 5,309,584 | A * | 5/1994 | Parker | 5/87.1 |
| 5,459,891 | A | 10/1995 | Reeve et al. | |
| 5,845,348 | A | 12/1998 | Dunn et al. | |
| D403,828 | S | 1/1999 | Greaves et al. | |
| 5,878,450 | A | 3/1999 | Bouhuijs | |
| 5,892,180 | A * | 4/1999 | Carey | 177/144 |
| 6,047,418 | A | 4/2000 | Seide et al. | |
| 6,161,232 | A | 12/2000 | Von Schroeter et al. | |
| 6,175,973 | B1 * | 1/2001 | Hakamiun et al. | 5/89.1 |
| 6,733,018 | B2 | 5/2004 | Razon | |
| 2005/0273927 | A1 * | 12/2005 | Tally | 5/86.1 |

* cited by examiner

*Primary Examiner*—Alexander Grosz

(57) ABSTRACT

The invalid lift apparatus provides a compact and portable device for lifting, supporting, and lowering an invalid. The invalid is lifted in a substantially single vertical plane, with a curved cushioned lift under each arm. Straps and harness safely and selectively secure the individual to the lifts. The screw jack provides exact height positioning of the invalid. The base deck cutout allows the invalid to access toileting and other needs. The carpet rollers and larger diameter pivotal wheels provide excellent maneuverability. The width no greater than 20 inches and length no greater than 30 inches provides apparatus access throughout a home, even through narrow doorways.

3 Claims, 9 Drawing Sheets

INVALID LIFT APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Disabled individuals, often termed invalids, do not have complete control of their bodies. Such individuals often do not have the ability to rise, stand, lower themselves, or walk. Examples of such individuals include those suffering from Parkinson's disease, Alzheimer's, accidents, and those faced with surgical recovery. These individuals must therefore rely on caregivers to assist with or perform for them necessary daily activities. Such activities include bathing, applying medication, removing or fitting clothing, changing bed linens, housekeeping, and lavatory needs. Few caregivers have the strength and ability to lift invalids into or out of various positions, especially a seated position. Invalids therefore often require additional lifting equipment to assist caregivers. Cost is a major consideration, in both human assistance and in equipment needed to assist in lifting and lowering invalids. The present apparatus provides a cost effective solution to the problems encountered in lifting, supporting, and lowering invalids, especially within a household.

FIELD OF THE INVENTION

The invalid lift apparatus relates to devices for assisting in invalid care and more especially to an invalid lift apparatus for lifting an invalid straight up and down, supporting them between such positions, and transporting them from one location to another

SUMMARY OF THE INVENTION

The general purpose of the invalid lift apparatus, described subsequently in greater detail, is to provide a invalid lift apparatus which has many novel features that result in an improved invalid lift apparatus which is not anticipated, rendered obvious, suggested, or even implied by prior art, either alone or in combination thereof.

To attain this, the invalid lift apparatus is designed primarily for home use where space limitations are encountered and thereby prohibit the use of larger, more complex and expensive devices. Dimensions of the apparatus are important in that they permit maneuverable movement of the apparatus and individual in a minimum of space, while still providing safety in doing so. The 2 inch carpet rollers and low profile of the base allows for the rear portion of the apparatus to be positioned beneath a couch, chair, bed or other typical object while providing vertical lift direct to the invalid. Vertical lift application is an important feature of the apparatus as small spaces within a home remain negotiable while lifting, supporting, and lowering an invalid. Unlike other devices the invalid is not displaced forwardly or backwardly, other than very slightly, in raising and lowering. Additionally, a standard potty chair can be positioned atop the base of the apparatus so that an invalid can be raised and lowered into and from the correct position, respectively. Also, a shower stool, with or without back, can be placed on the base either for use in transporting an invalid throughout a house or in showering. Optional shower readiness is provided via sealed electrics and mechanicals and overall finish of the components of the apparatus. The cutout of the base provides for positioning of an invalid over a commode and lowered and raised as needed, negating any necessity for complete transfer of the individual to and from the apparatus to a commode. The two padded lifting arms with straps can be used as needed for supporting an invalid under the arms and shoulders in positions as needed. Further, the non-skid material coating on the base prevents any accessory device, such as chair or stool, from slipping.

Dimensions of the apparatus are important. The base measures no more than 20 inches wide and 30 inches in length. The width allows easy movement through 22 inch doorways, and the length provides for ease in maneuverability of the apparatus. The lift arm and human lifting components are positioned slightly forward of centerline for safe support of a user.

Overall weight of the apparatus figured significantly in design choices. One healthy individual can transport the apparatus. Strength and light weight is enhanced by the use of square tubing wherever possible. Various appropriate metals or synthetics can be used in forming the tubing. The 12-volt gel battery is removable. The lifting arm is separable from the screw jack, and the screw jack separable from the base. The outer lift arms are separable from the crosspiece. The ease and ability of the apparatus to be separated provides easy portability. In order that the apparatus be useful in the event of power outage, and fully portable, the battery and 120-volt trickle charger were chosen. These features are important in portability and size and weight, as compared to a pneumatic device or a device having a hydraulic pump and storage and generator. The screw jack provides reliable positioning without the chance for bleed down, as can occur with direct hydraulic lifts. The screw jack also provides for more easily and accurately positioning of the lift arm.

The under arm cushioned lifts provide for the most supportive lift of an invalid and negate the need for a lift under a persons buttocks and legs, as some devices rely on. These under arm lifts thereby negate having to access the underside of an invalid in order to raise and lower them, and also provide for the capabilities noted above in use in toileting and other needed activities. The shoulder straps insure that an invalid's shoulders and arms do not slip from the cushioned lifts.

The safety harness is comprised of two harness straps of seat belt type material and construction. One of each of the straps is affixed to one of the outer lift arms, respectively. Each has complimentary hook and loop on a significant portion of their outer ends to provide adjustable fit to an invalid. The safety harness straps loop around and are fastened behind an invalid's back to ensure that shoulders and hence underarms remain positioned on the cushioned lifts.

The apparatus can safely support an invalid of up to 300 pounds. Optional embodiments which can support higher weights are available. Ideally, combinations of materials are used, which include but are not limited to aluminum, steel, composites, and various cushioning and coating materials. The design of the apparatus is important in the relative light weight for the strength in support offered, with each construction feature adding to a total capability and basic design not offered in other similar devices. Complex swiveling invalid support components and the like are avoided, as are accompanying expenses. Dual lift components are avoided. Slings are avoided. In brief, the apparatus affords strength, portability, and basic design. Superior mechanical lifting leverage is provided by the screw jack being placed within the bounds of the apparatus, between the base and lift arm.

Thus has been broadly outlined the more important features of the improved invalid lift apparatus so that the detailed description thereof that follows may be better understood and in order that the present contribution to the art may be better appreciated.

An object of the invalid lift apparatus is to support, raise, and lower an invalid in minimal deviation from a single vertical plane.

Another object of the invalid lift apparatus is to be easily portable and to pass through house doorways.

A further object of the invalid lift apparatus is to negate any downward movement of the lift arm once selectively positionally placed.

An added object of the invalid lift apparatus is to provide for supporting an invalid during toilet use and other necessary activities.

And, an object of the invalid lift apparatus is to support an invalid via underarms.

These together with additional objects, features and advantages of the improved invalid lift apparatus will be readily apparent to those of ordinary skill in the art upon reading the following detailed description of presently preferred, but nonetheless illustrative, embodiments of the improved invalid lift apparatus when taken in conjunction with the accompanying drawings.

In this respect, before explaining the current embodiments of the improved invalid lift apparatus in detail, it is to be understood that the invalid lift apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved invalid lift apparatus. It is therefore important that the claims be regarded as including such equivalent constructions insofar as they do not depart from the spirit and scope of the invalid lift apparatus. It is also to be understood that the phraseology and terminology employed herein are for purposes of description and should not be regarded as limiting.

DETAILED DESCRIPTION OF THE DRAWINGS

Figure 1:
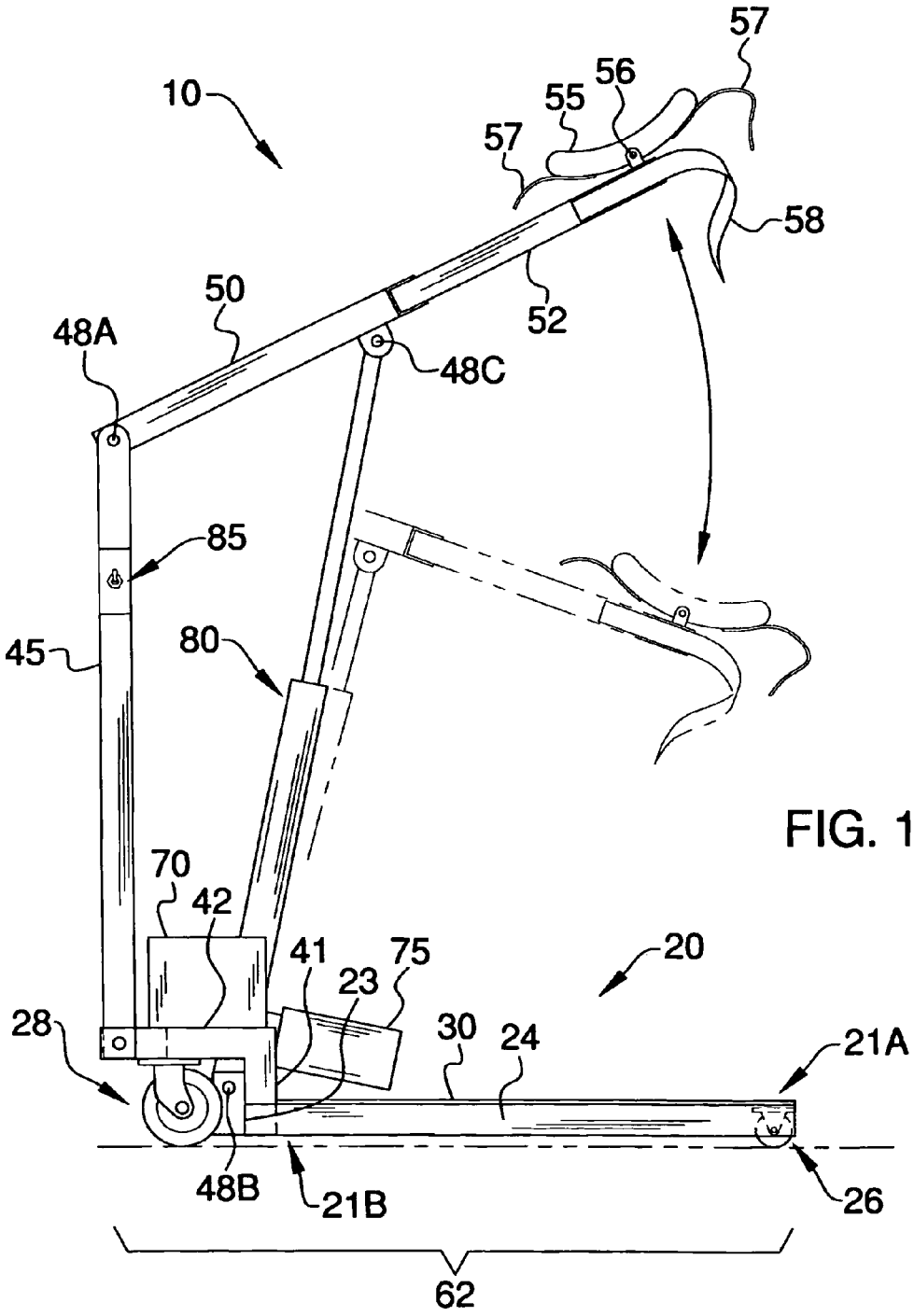
FIG. 1 is a lateral elevation view illustrating lift arm movement.
Figure 2:
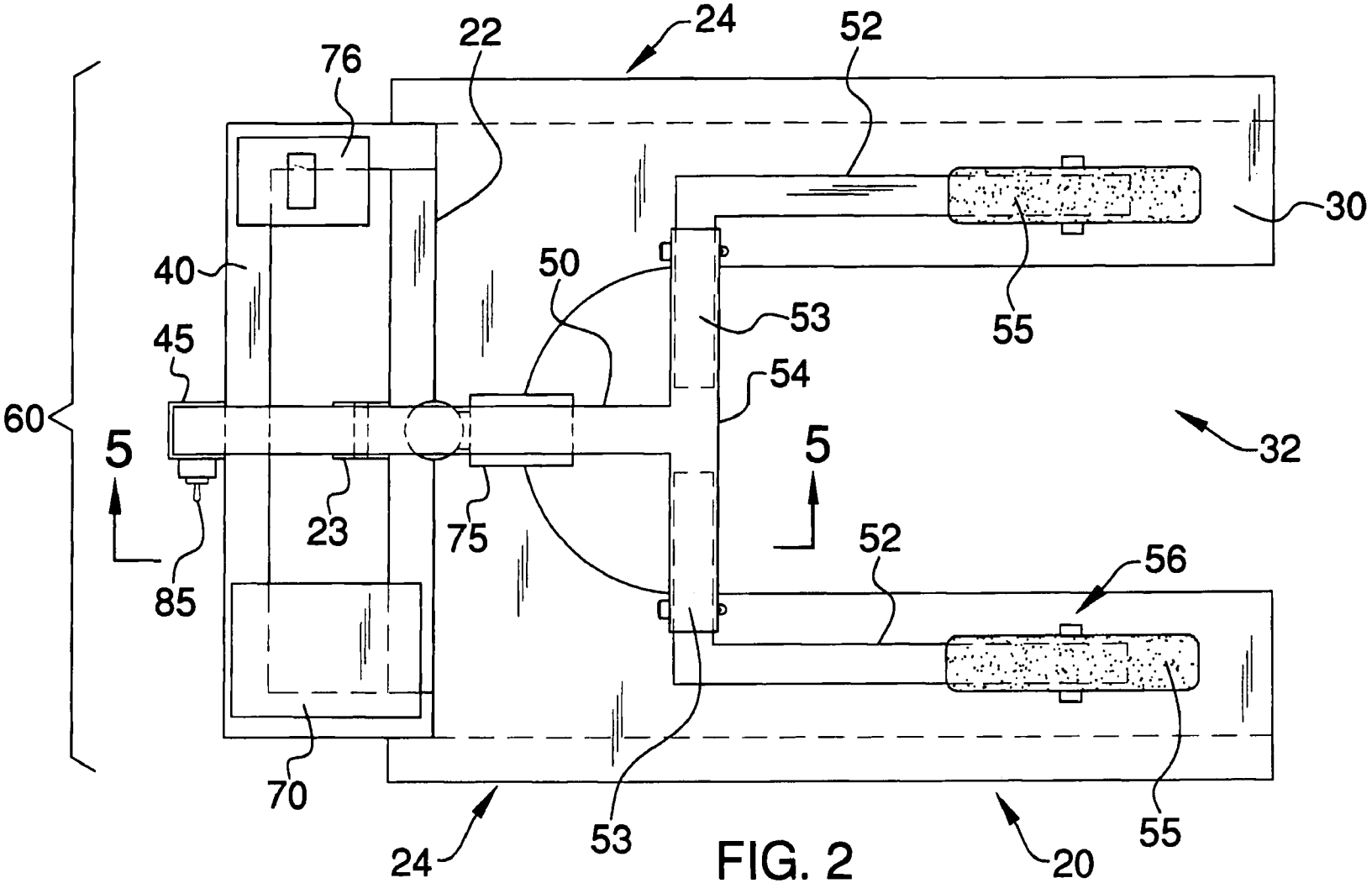
FIG. 2 is a top plan view.
Figure 3:
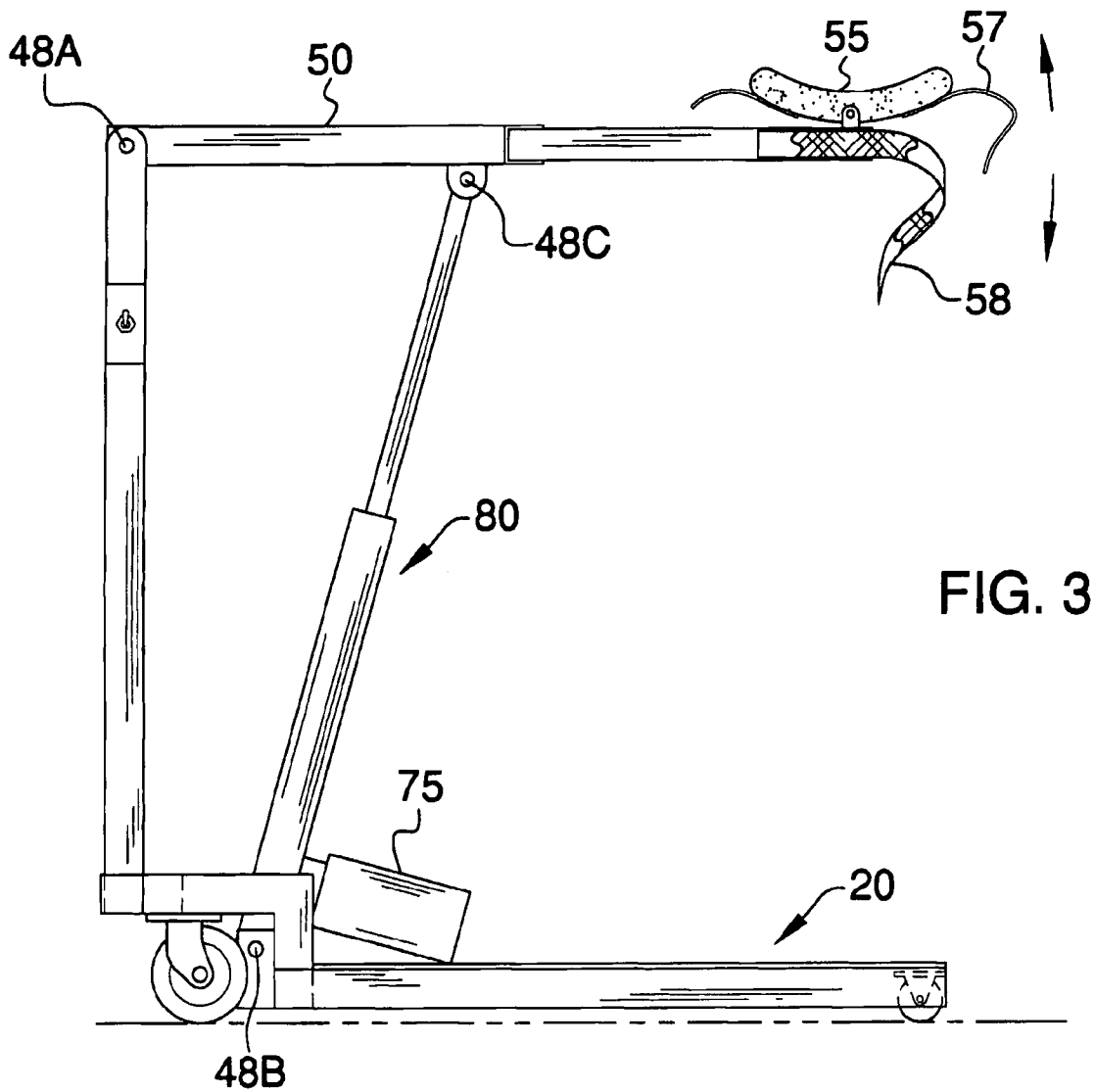
FIG. 3 is a lateral elevation view.
Figure 4:
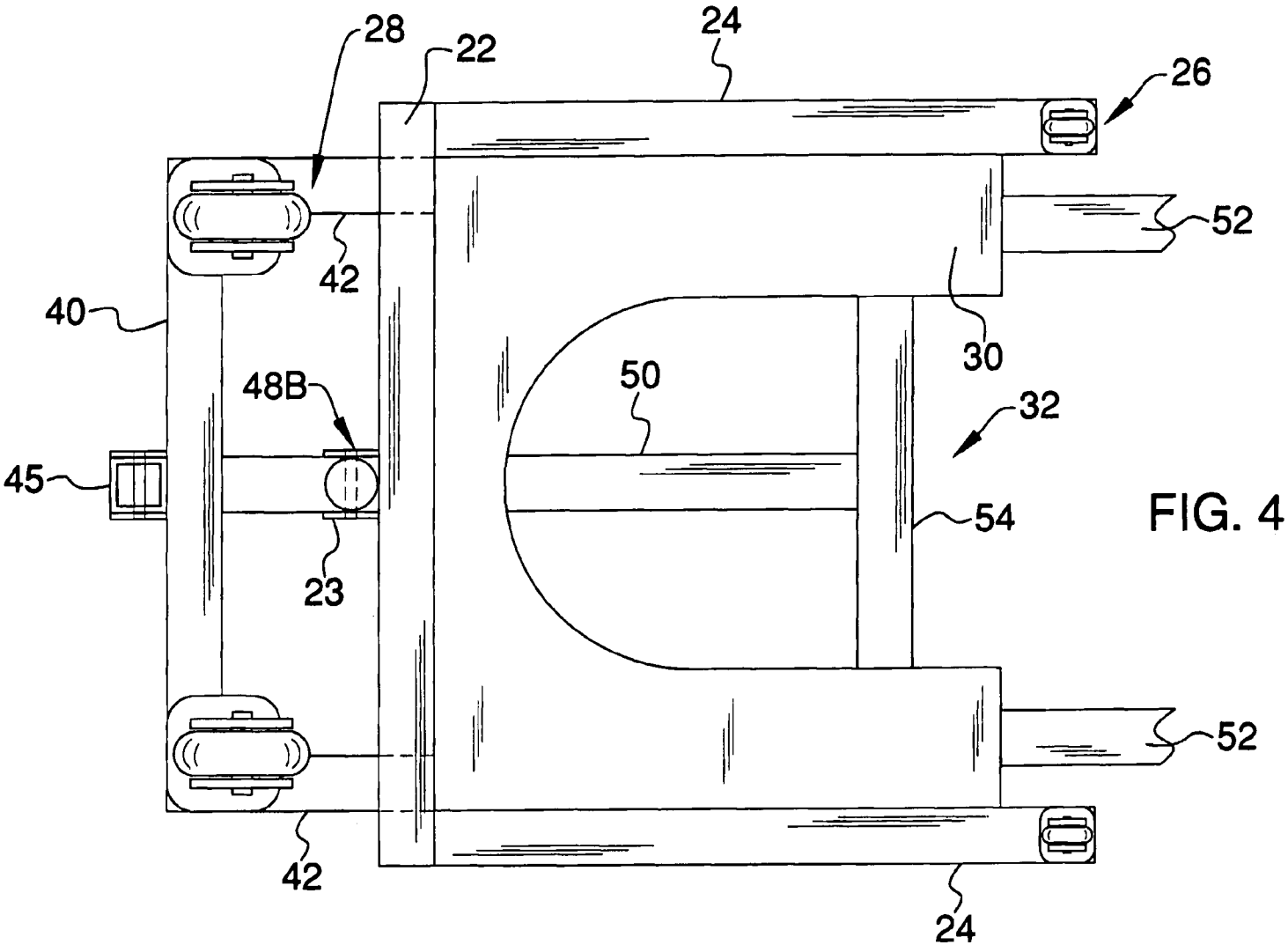
FIG. 4 is a bottom plan view.
Figure 5:
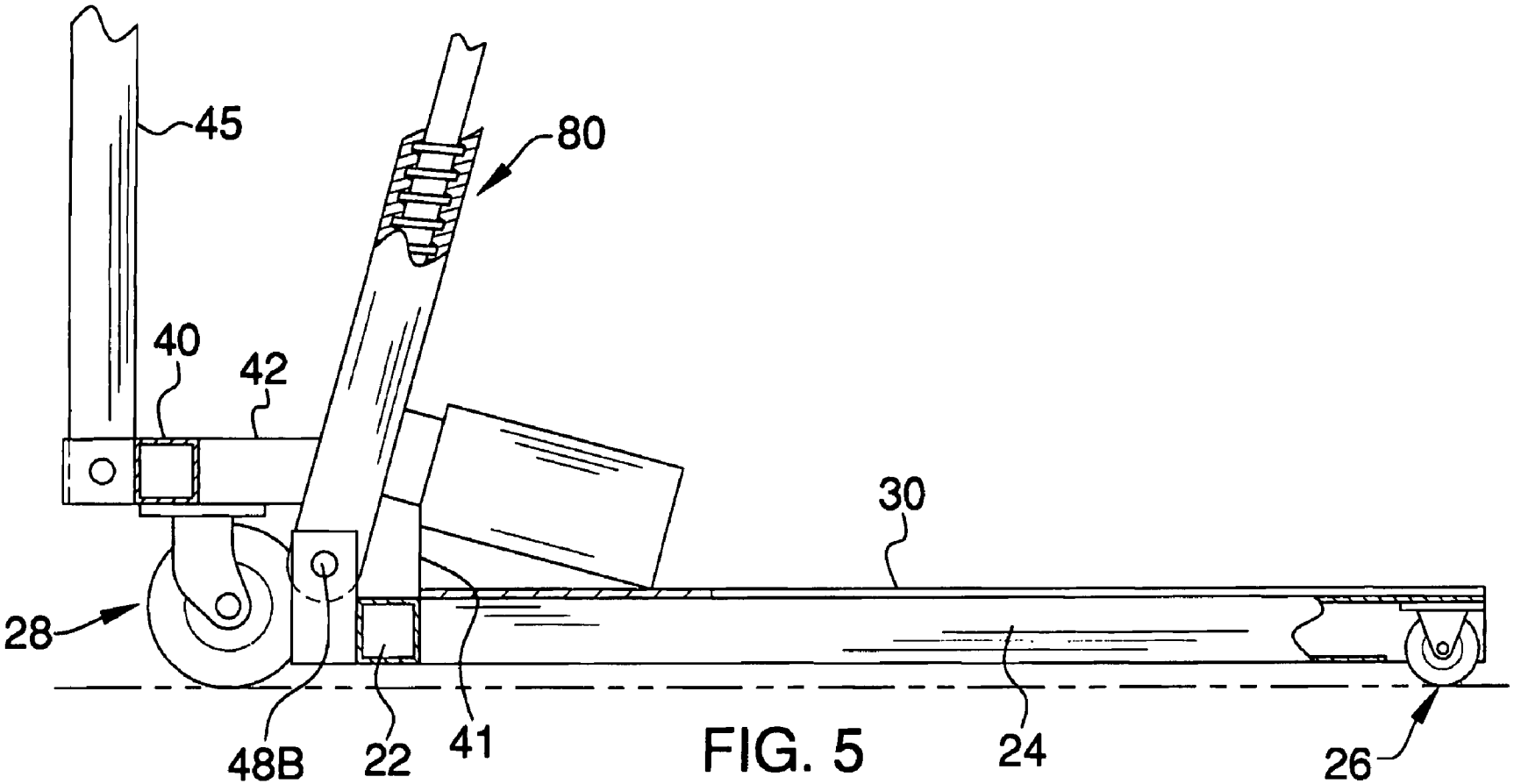
FIG. 5 is a partial cross sectional view of FIG. 2.
Figure 6:
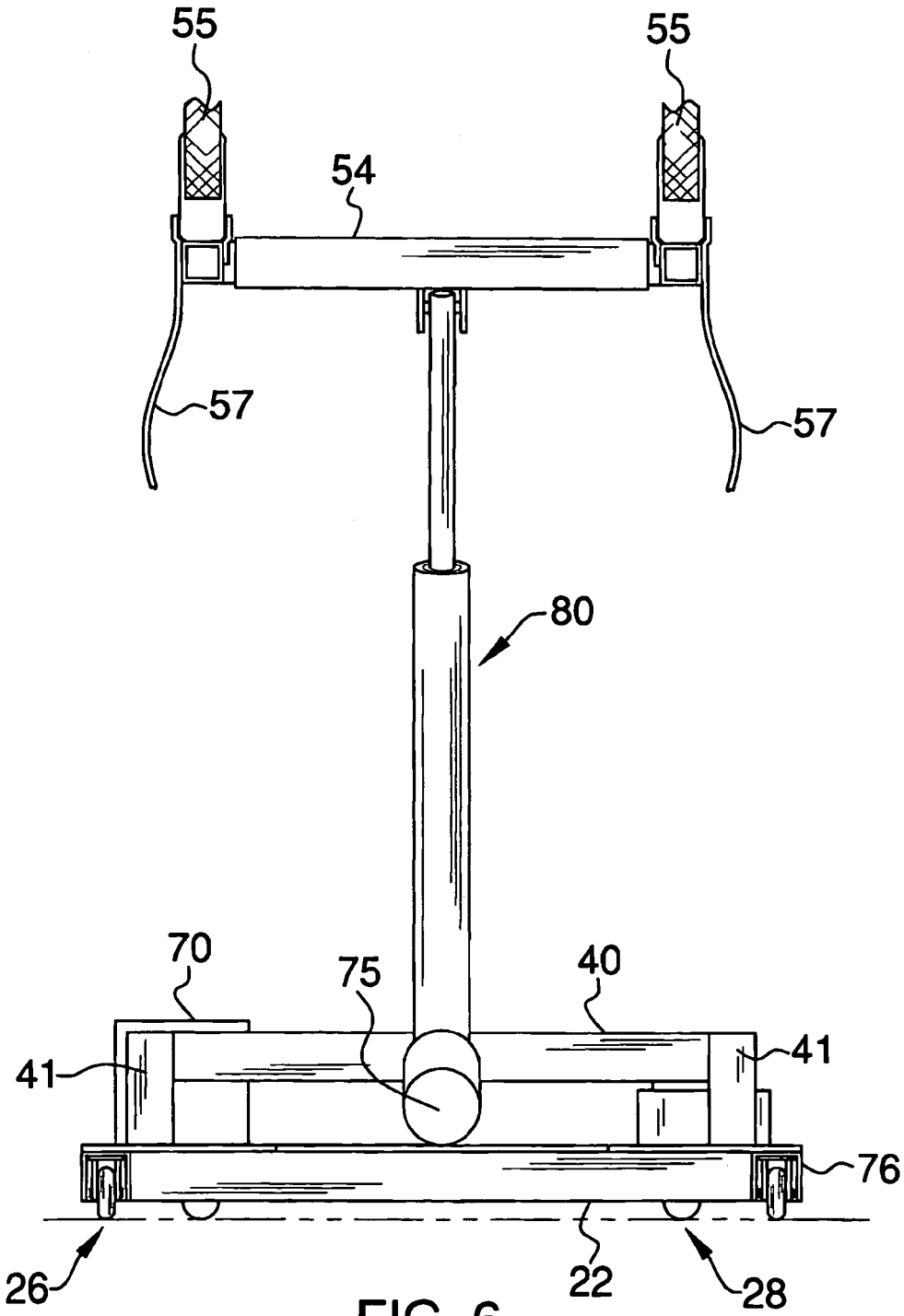
FIG. 6 is a rear elevation view.

With reference now to the drawings, and in particular FIGS. 1 through 9 thereof, the principles and concepts of the invalid lift apparatus generally designated by the reference number 10 will be described.

Referring to FIGS. 1-6, the invalid lift apparatus 10 partially comprises the base 20 which has a rear 21*a* and a front 21*b*. The base 20 further comprises the square tube transverse 22 at the front 21*b*. The jack support 23 is centrally disposed on the transverse 22. One of each of the pair of spaced apart longitudinals 24 is perpendicularly connected to each end of the transverse 22, respectively. The deck 30 is disposed atop the transverse 22 and the longitudinals 24. The u-shaped cutout 32 is centered within the deck 30. The cutout 32 is open to the rear 21*a*. The importance of the cutout 32 cannot be overstated, as the cutout 32 provides for invalid 90 access to a toilet 95 or other furniture or appliance, with the invalid 90 still supported by the apparatus 10. A carpet roller 26 is disposed on the rear end of each longitudinal 24. Carpet rollers 26 are more easily moved on less than slick surfaces. The pair of spaced apart uprights 41 is affixed atop the transverse 22. Each upright 41 is disposed adjacent to one of the longitudinals 24, respectively. Of the pair of spaced apart supports 42, each is affixed to one of the uprights 41, respectively. The frame transverse 40 connects the parallel supports 42. A pivoting rear wheel 28, of a larger diameter than the carpet rollers 26, is fitted to the junction of each support 42 and frame transverse 40. It is important to note that the relatively small carpet rollers 26 provide for the base 20 to fit under various appliances and furniture items while the larger diameter pivoting wheels 28 provide excellent maneuverability for the entire apparatus 10. The battery 70 is disposed atop one of the supports 42. The charger 76 is disposed atop one of the supports 42. The charger 76 is in communication with the battery 70. The vertical arm 45 is perpendicularly and centrally affixed to the frame transverse 40. The lift arm 50 is pivotally connected to the top of the vertical arm 45 via the first pivot 48*a*.

Figure 7:
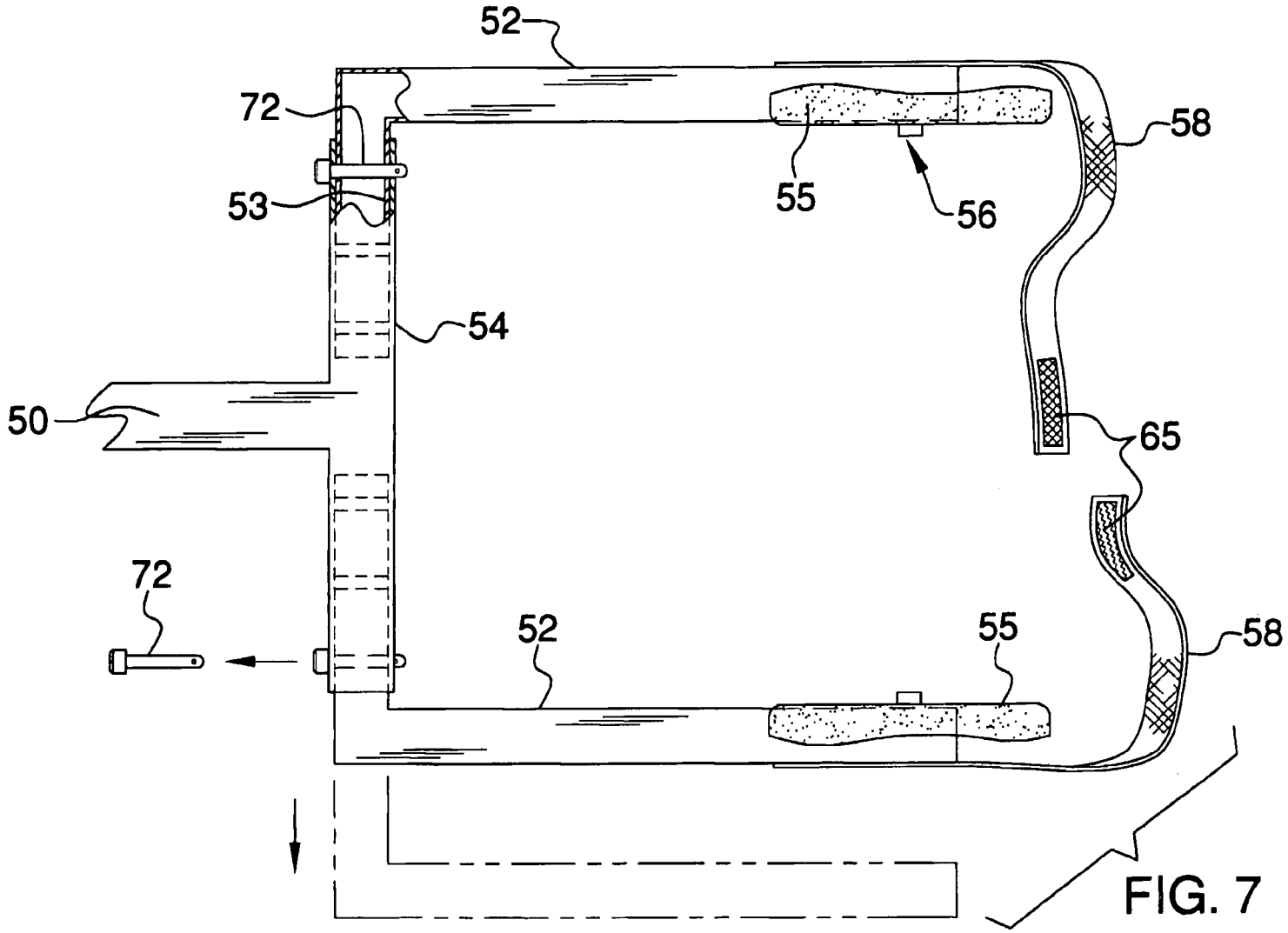
FIG. 7 is a top partial cross sectional elevation view of the crosspiece and outer lift arms.
Figure 8:
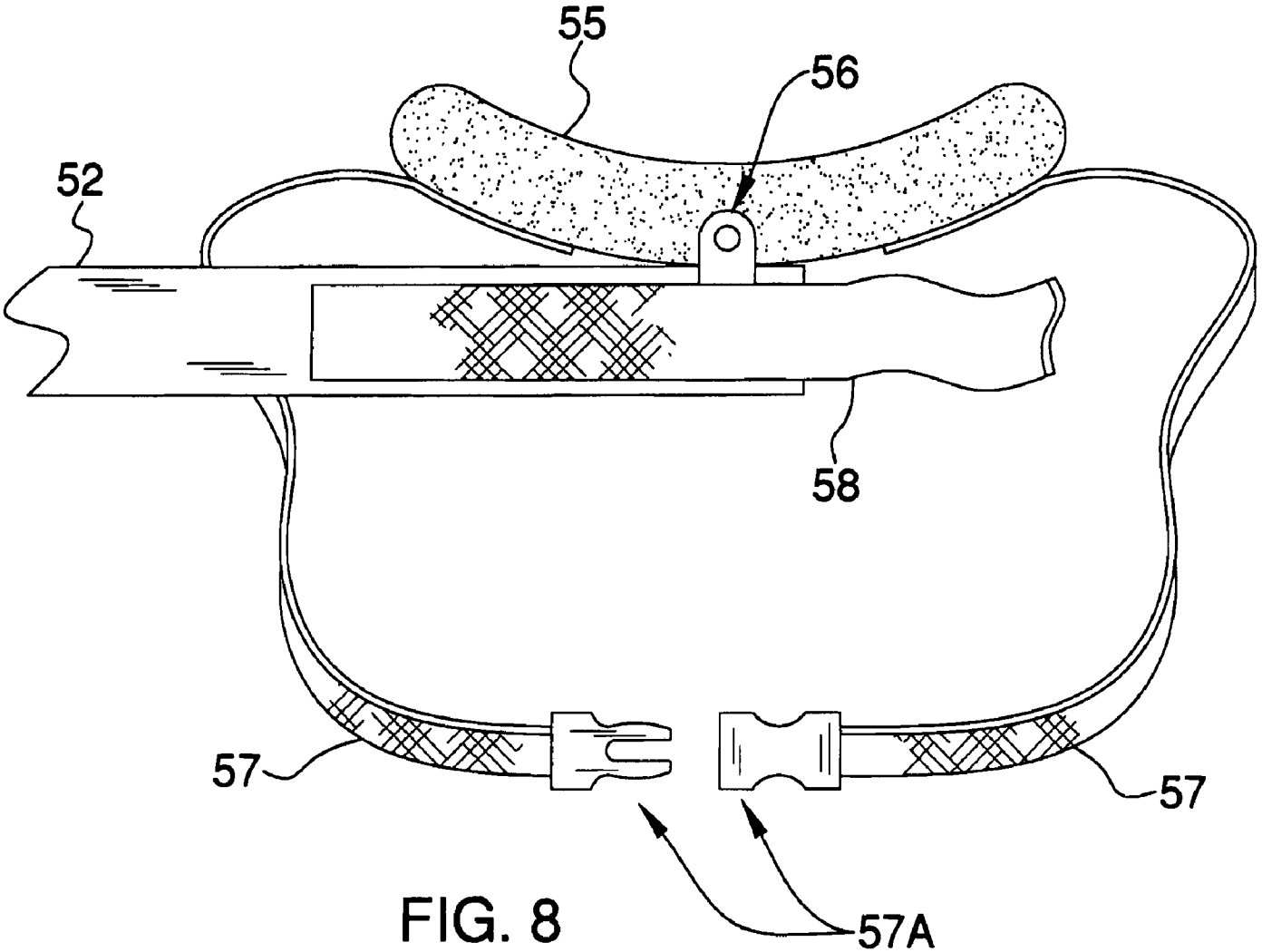
FIG. 8 is a lateral elevation view of swivel attachment of one cushioned lift to one of the outer lift arms, and of shoulder straps and harness strap.
Figure 9:
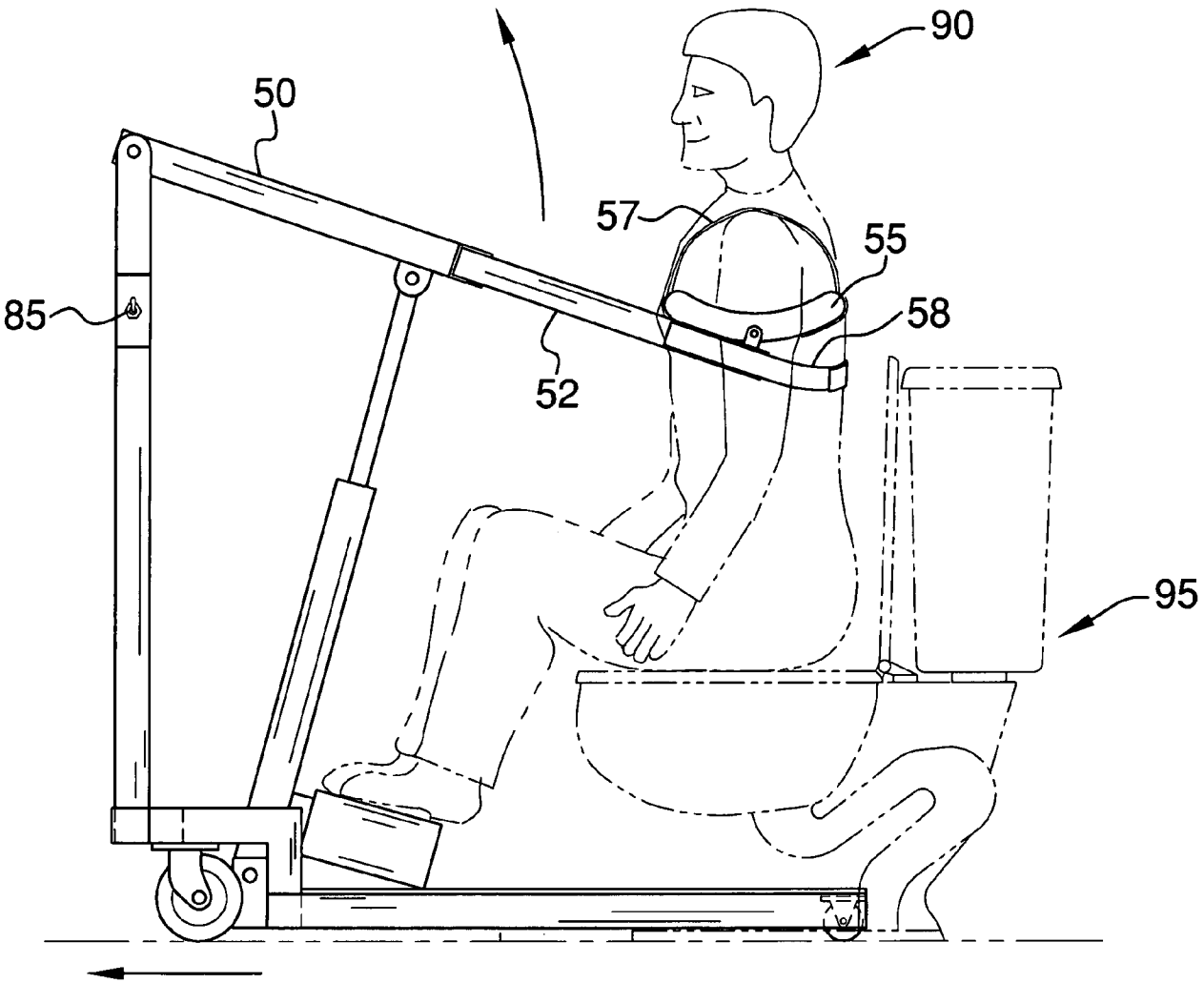
FIG. 9 is a lateral elevation view of the apparatus in use in toileting.

Continuing to refer to FIGS. 1-6 and also to FIGS. 7-9, the crosspiece 54 is perpendicularly affixed to the lift arm 50. One insert 53 is removably fitted to each end of the crosspiece 54, each via a removable pin 72. An outer lift arm 52 is perpendicularly and forwardly connected to each insert 53. A harness strap 58 is affixed forwardly to each outer lift arm 52. The harness straps 58 are selectively connected behind the back of an invalid 90 via the complimentary hook and loop 65 on each harness strap 57. A curved cushioned lift 55 is swively affixed atop each outer lift arm 52 via a swivel 56. Each cushioned lift 55 is selectively fitted under an arm of the invalid 90, respectively. The curve of each cushioned lift 55 is important is assisting in retaining an invalid's 90 position and in providing comfort. A pair of shoulder straps 57 is affixed to the underside of each cushioned lift 55. With each pair of shoulder straps 57 one is selectively affixed to the other via the buckle 57*a*. The screw jack 80 lower end is pivotally and removably fitted to the jack support 23 via the second pivot 48*b*. The upper end of the screw jack 80 is pivotally and removably fitted to the lift arm 50 via the third pivot 48*c*, proximal to the crosspiece 54. The motor 75 is attached to the lower end of the screw jack 80. The motor 75 is in communication with the control 85. The control 85 is ideally fitted to the vertical arm 45. The control 85 is further in communication with the battery 70. The lift arm 50 and hence outer lift arms 52 selectively support, raise, and lower the invalid 90, via the control 85.

The apparatus 10 has a length 62 of about 30 inches and a width 60 of about 20 inches, thereby enabling easy maneuvering and door passage throughout a household.

With respect to the above description then, it is to be realized that the optimum dimensional relationships for the parts of the invalid lift apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the invalid lift apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the invalid lift apparatus may be used.

Therefore, the foregoing is considered as illustrative only of the principles of the invalid lift apparatus. Further, since numerous modifications and changes will readily occur to those skilled in the art, it is not desired to limit the invalid lift apparatus to the exact construction and operation shown and described, and accordingly, all suitable modifications and equivalents may be resorted to, falling within the scope of the invalid lift apparatus.

What is claimed is:

1. A portable invalid lift apparatus, comprising, in combination:

a base having a front and a rear, the base further comprising:

a square tube transverse at the front;

a jack support centrally disposed on the transverse;

a pair of spaced apart longitudinals perpendicularly connected to an each end of the transverse, respectively;

a deck, comprising a U-shaped cut out open towards the rear, disposed atop the transverse and the longitudinals;

a roller disposed on the rear of each longitudinal;

a pair of spaced apart uprights upwardly and perpendicularly affixed atop the transverse, each upright disposed adjacent to one of the longitudinals, respectively;

a pair of spaced apart supports, each support perpendicularly affixed to one of the uprights, respectively;

a frame transverse connecting the supports;

a pivoting front wheel fitted below a junction of each support and frame transverse;

a battery disposed atop one of the supports;

a charger disposed atop one of the supports, the charger in communication with the battery;

a vertical arm perpendicularly and centrally affixed to the frame transverse;

a lift arm pivotally connected to a top of the vertical arm via a first pivot;

a crosspiece perpendicularly affixed to the lift arm;

an insert removably fitted to an each end of the crosspiece;

an outer lift arm perpendicularly and forwardly connected to each insert;

a harness strap affixed forwardly to each outer lift arm, the harness straps selectively connected behind a back of an invalid;

a cushioned lift swively affixed atop each lift arm, each cushioned lift selectively fitted under an arm of the invalid, respectively;

a pair of shoulder straps affixed to an underside of each cushioned lift, each shoulder strap selectively affixed to the other;

a screw jack having a lower end pivotally and removably fitted to the jack support via a second pivot, an upper end of the screw jack pivotally and removably fitted to the lift arm via a third pivot proximal to the crosspiece;

a motor attached to the lower end of the screw jack, the motor in communication with a control and with the battery;

whereby the lift arm and outer lift arms support, raise, and lower the invalid in a substantially single vertical plane.

2. The apparatus according to claim 1 wherein the rear wheel further comprises a larger diameter than a diameter of the carpet rollers.

3. A portable invalid lift apparatus, comprising, in combination:

a length of about 30 inches;

a width of about 20 inches;

a base having a front and a rear, the base further comprising:

a square tube transverse at the front;

a jack support centrally disposed on the transverse;

a pair of spaced longitudinals perpendicularly connected to an each end of the transverse;

a deck disposed atop the transverse and the longitudinals;

a u-shaped cutout centered within the deck, the cutout open to the rear;

a roller disposed on a distal end of each longitudinal;

a pair of spaced apart uprights upwardly and perpendicularly affixed atop the transverse, each upright disposed adjacent to one of the longitudinals, respectively;

a pair of spaced apart supports, each support perpendicularly affixed to one of the uprights, respectively;

a frame transverse connecting the supports;

a pivoting rear wheel fitted below a junction of each support and frame transverse, each rear wheel having a diameter greater than a diameter of the rollers;

a battery disposed atop one of the rear supports;

a charger disposed atop one of the rear supports, the charger in communication with the battery;

a vertical member perpendicularly and centrally affixed to the frame transverse;

a lift arm pivotally connected to a top of the vertical member;

a crosspiece perpendicularly affixed to the lift arm;

an insert removably fitted to an each end of the crosspiece;

an outer lift arm perpendicularly and forwardly connected to each insert;

a harness strap affixed forwardly to each outer lift arm, the harness straps selectively connected behind a back of an invalid;

a curved cushioned lift swively affixed atop each lift arm, each cushioned lift selectively fitted under an arm of the invalid, respectively;

a pair of selectively buckled shoulder straps affixed to an underside of each cushioned lift;

a screw jack having a lower end removably and pivotally fitted to the jack support, an upper end of the jack support removably and pivotally fitted to the lift arm, proximal to the crosspiece;

a motor attached to the lower end of the screw jack, the motor in communication with a control and with the battery;

whereby the lift arm and outer lift arms support, raise, and lower the invalid.

* * * * *